US010333247B2

(12) United States Patent
Oka

(10) Patent No.: US 10,333,247 B2
(45) Date of Patent: Jun. 25, 2019

(54) WIRE HARNESS

(71) Applicant: Hitachi Metals, Ltd., Tokyo (JP)
(72) Inventor: Taichi Oka, Hitachi (JP)
(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/558,988
(22) PCT Filed: Mar. 19, 2015
(86) PCT No.: PCT/JP2015/058223
§ 371 (c)(1),
(2) Date: Jan. 5, 2018
(87) PCT Pub. No.: WO2016/147376
PCT Pub. Date: Sep. 22, 2016

(65) Prior Publication Data
US 2018/0109031 A1 Apr. 19, 2018

(51) Int. Cl.
*H01R 13/58* (2006.01)
*H01R 13/533* (2006.01)
(Continued)

(52) U.S. Cl.
CPC ..... *H01R 13/5808* (2013.01); *H01B 7/0045* (2013.01); *H01R 4/183* (2013.01);
(Continued)

(58) Field of Classification Search
CPC ..... H01R 13/5808
USPC ..... 439/579
See application file for complete search history.

(56) References Cited

U.S. PATENT DOCUMENTS 5,171,162 A * 12/1992 Kaufman ..... H01R 9/0509 439/394
7,845,977 B2 * 12/2010 Cook ..... H01R 9/0524 439/578
(Continued)

FOREIGN PATENT DOCUMENTS

JP 2014-022330 A 2/2014
JP 2014-154255 A 8/2014

OTHER PUBLICATIONS

International Search Report (ISR) (PCT Form PCT/ISA/210), in PCT/JP2015/058223, dated May 12, 2015.
(Continued)

*Primary Examiner* — Alexander Gilman
(74) *Attorney, Agent, or Firm* — McGinn I. P. Law Group, PLLC.

(57) ABSTRACT

In order to provide a wire harness with which it is possible to suppress vibration of a coating material and a central conductor between a shield conductor swaging position and a terminal, this wire harness (1) is provided with: a first cable (21) that has a central conductor (201), a coating material (202) that coats the central conductor (201), and a shield conductor (203) that covers the coating material (202); a terminal (30) that is connected to the central conductor (201) of the cable (21); a connector housing (40) that houses an end of the first cable (21) along with the terminal (30); a first ferrule (51) that is electrically connected to the shield conductor (203) and has the central conductor (201) and the coating material (202) inserted thereinto; and a fixing member (61) that fixes the first ferrule (51) to the connector housing (40). The first ferrule (51) has a first swaging portion (511) for swaging the shield conductor (203) and a second swaging portion (512) for swaging the coating material (202), said second swaging portion (512) being positioned further to the terminal (30) side than the first swaging portion (511).

20 Claims, 7 Drawing Sheets

(51) Int. Cl.

| | |
|---|---|
| ***H01B 7/00*** | (2006.01) |
| ***H01R 4/18*** | (2006.01) |
| ***H01R 24/38*** | (2011.01) |
| ***H01R 9/05*** | (2006.01) |
| *H01R 103/00* | (2006.01) |
| *H01R 105/00* | (2006.01) |
| *H01R 4/20* | (2006.01) |
| *H01R 13/621* | (2006.01) |
| *H01R 13/6592* | (2011.01) |
| *H01R 24/20* | (2011.01) |

(52) U.S. Cl.
CPC ..... *H01R 9/0518* (2013.01); *H01R 13/533* (2013.01); *H01R 24/38* (2013.01); *H01R 4/20* (2013.01); *H01R 13/621* (2013.01); *H01R 13/6592* (2013.01); *H01R 24/20* (2013.01); *H01R 2103/00* (2013.01); *H01R 2105/00* (2013.01)

(56) References Cited

U.S. PATENT DOCUMENTS

| | | | | |
|---|---|---|---|---|
| 7,887,380 | B2 * | 2/2011 | Ross | H01R 11/12 29/882 |
| 8,414,330 | B2 * | 4/2013 | Yamada | H01R 13/4226 439/579 |
| 8,419,468 | B2 * | 4/2013 | Alrutz | H01R 13/622 439/321 |
| 8,519,267 | B2 * | 8/2013 | Peters | H01R 4/203 174/122 C |
| 9,009,960 | B2 * | 4/2015 | Vaccaro | H01R 13/111 29/874 |
| 9,985,362 | B2 * | 5/2018 | Arenburg | H01R 4/70 |
| 9,991,611 | B1 * | 6/2018 | Jameson | H01R 4/4809 |
| 10,014,600 | B1 * | 7/2018 | Mori | H01R 9/0518 |
| 10,027,042 | B2 * | 7/2018 | Turner | H01R 4/183 |

OTHER PUBLICATIONS

Japanese Office Action, dated Sep. 4, 2018, in Japanese Application No. 2017-505971 and English Translation thereof.

Notification of Transmittal of Translation of the International Preliminary Report on Patentability (PCT/IB/338) in PCT Application No. PCT/JP2015/058223 dated Sep. 28, 2017 (and English translation of Written Opinion).

* cited by examiner

WIRE HARNESS

FIELD OF THE INVENTION

The present invention relates to a wire harness comprising a cable having a shield conductor and a connector housing that houses an end of the cable.

BACKGROUND OF THE INVENTION

As a conventional wire harness, a wire harness described in Patent Literature 1 has been known. This wire harness comprises a plurality of cables, a pair of terminals connected to respective ends of the plurality of cables, and a housing that houses the ends of the respective cables together with the pair of terminals.

The cable comprises a central conductor connected to the terminal, a coating material comprising an insulator for coating the central conductor (insulating coating), a braid shield formed at an outer periphery of the coating material, and a sheath covering the braid shield. An end of the braid shield is exposed from the sheath and folded back, and it is swaged at the outside of the sheath by a ferrule.

The housing is constituted from first to fourth housing members, and the second housing member comprises resin, while the first, third, and fourth housing members comprise metal such as aluminum. The third and fourth housing members are formed in a tubular shape, and the ferrule is housed therein. Also, the third and fourth housing members are fitted into fit holes formed in the first housing member by press fitting.

In the second housing member, a connecting portion formed at one end in an extending direction of the cable in the housing is fitted into the first housing member. Also, the second housing member has a terminal holding portion at the other end opposite to the connecting portion, and a pair of terminals are held by this terminal holding portion.

PRIOR ART DOCUMENTS

Patent Literature

Patent Literature 1: JP-A 2014-154255

SUMMARY OF THE INVENTION

Problem to be Solved by the Invention

The wire harness may be subjected to a strong vibration continuously depending on its application use. When the wire harness configured as described above is mounted on e.g. a vehicle and is subjected to the vibration due to the running, if a distance between the terminal and a part of the cable swaged by the ferrule is long, the conductor and the coating material provided therebetween may oscillate, thereby may affect the durability of the cable. This may become a factor that can restrain the application use of the wire harness.

Accordingly, it is an object of the present invention to provide a wire harness which can suppress the vibration of a central conductor and a coating material between a swaging position of a shield conductor and a terminal.

Means for Solving the Problems

For solving the above problem, the present invention provides a wire harness, comprising:

a cable comprising a central conductor, a coating material that coats the central conductor, and a shield conductor that covers the coating material;

a terminal that is connected to the central conductor of the cable;

a connector housing that houses an end of the cable together with the terminal;

a ferrule, that is electrically connected to the shield conductor and comprises a tubular metal, into which the central conductor and the coating material inserted; and a fixing member that fixes the ferrule to the connector housing, wherein the ferrule comprises a swaging portion for swaging the shield conductor and a tightening portion for tightening the coating material, wherein the tightening portion is located closer to the terminal than the swaging portion.

Effect of the Invention

According to the wire harness according to the present invention, it is possible to suppress the vibration of a central conductor and a coating material between a swaging position of a shield conductor and a terminal.

DETAILED DESCRIPTION OF THE EMBODIMENT

Embodiment

Figure 1:
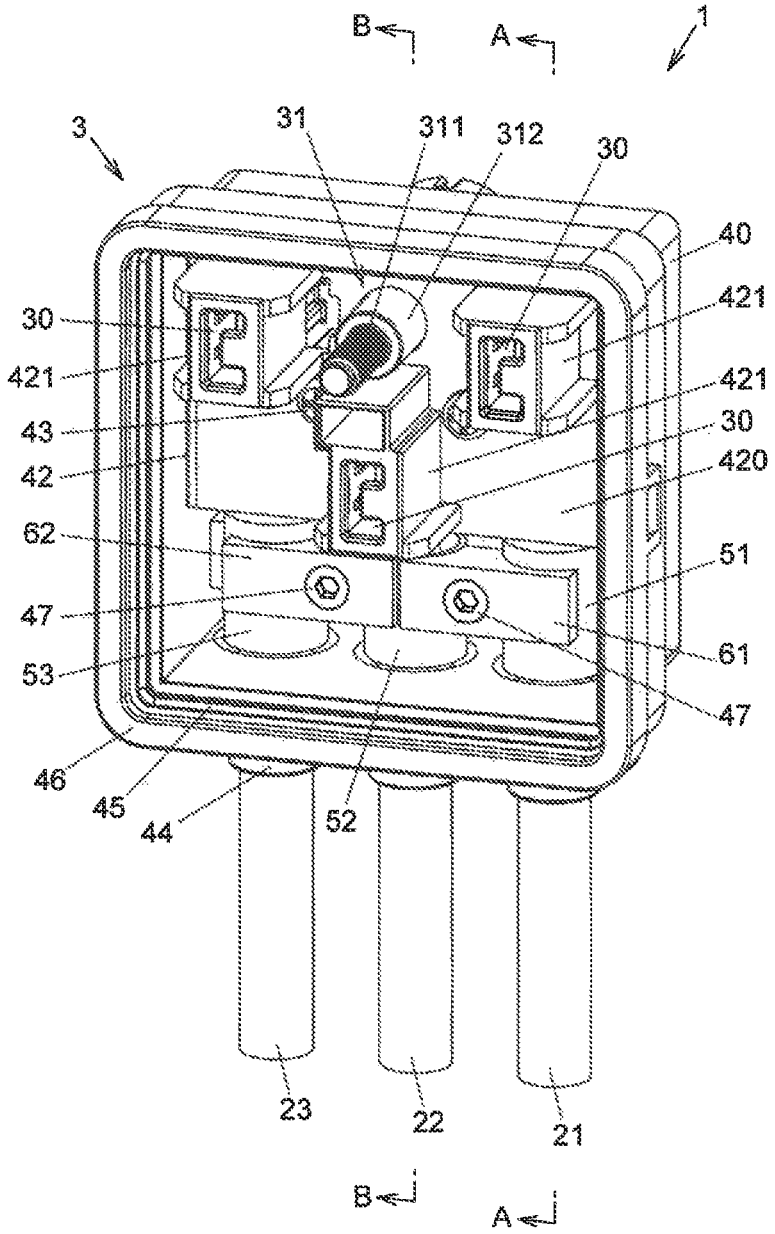
FIG. 1 is a perspective view showing a wire harness in an embodiment of the present invention.
Figure 2:
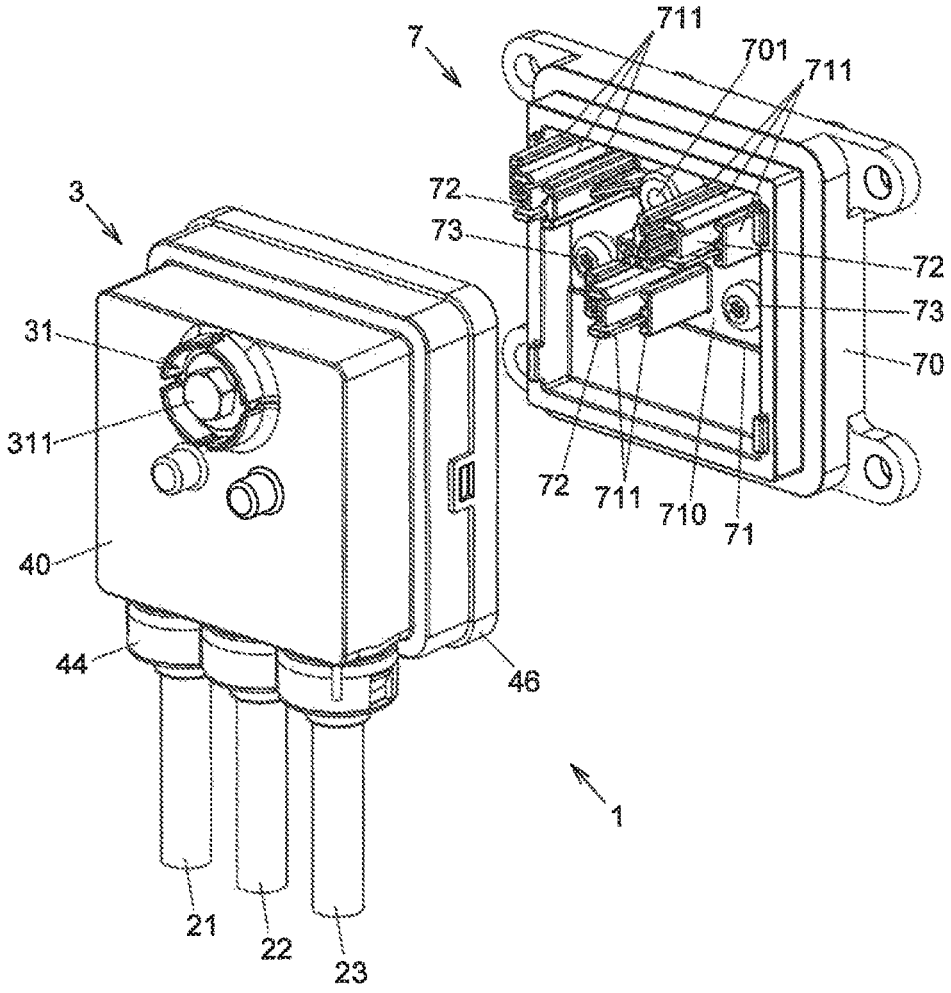
FIG. 2 is a perspective view showing the wire harness together with a connector to which the wire harness is fitted.
Figure 3:
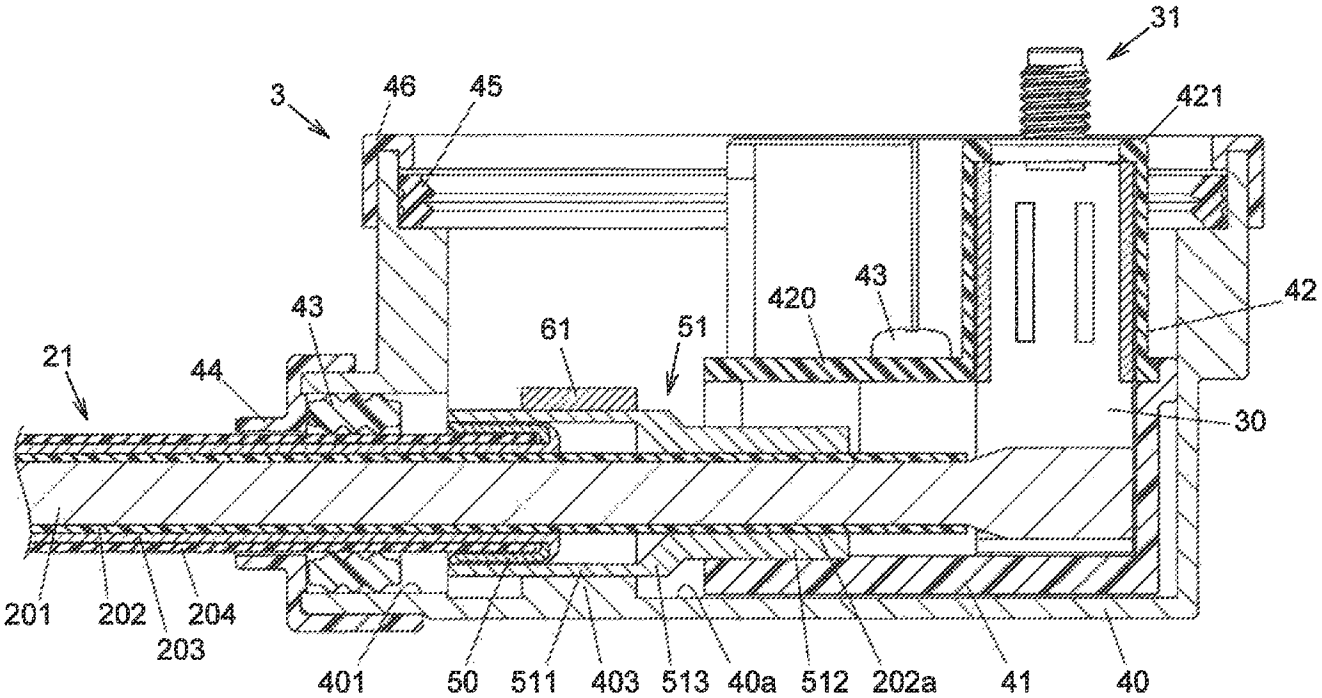
FIG. 3 is a cross sectional view along A-A line in FIG. 1.
Figure 4:
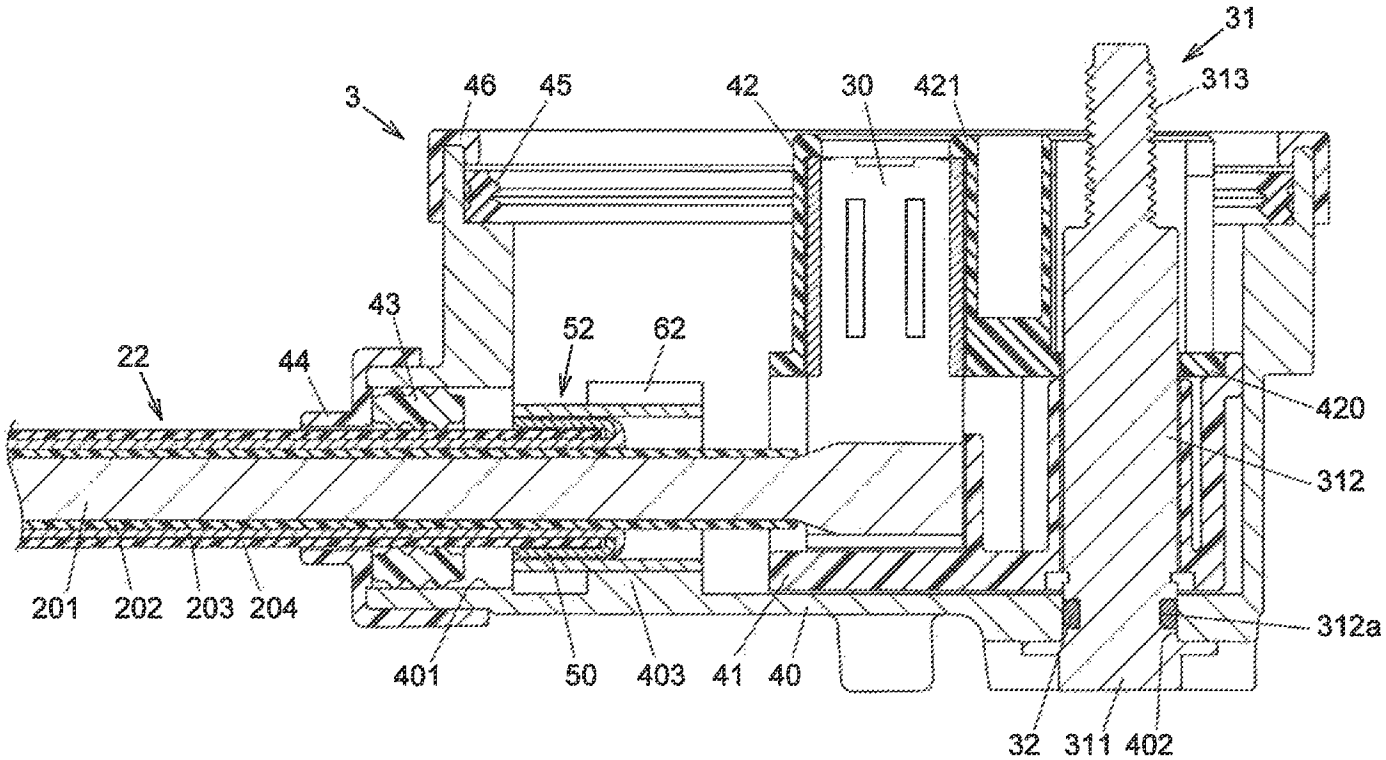
FIG. 4 is a cross sectional view along B-B line in FIG. 1.

FIG. 1 is a perspective view showing a wire harness in an embodiment of the present invention. This wire harness 1 comprises three cables (first to third cables 21 to 23), and a connector 3 provided at ends of the three cables. In FIG. 1, only a portion in a longitudinal direction of three cables on a connector 3 side is shown. FIG. 2 is a perspective view showing the wire harness 1 together with a connector 7 to which the wire harness 1 is fitted. FIG. 3 is a cross sectional view along A-A line in FIG. 1. FIG. 4 is a cross sectional view along B-B line in FIG. 1.

The wire harness 1 connects an electric motor for generating a driving force for running in a vehicle and a power-supply unit (inverter) which supplies an electric current to this electric motor. This electric motor is a three-phase AC motor and receives alternate currents at U-phase, V-phase and W-phase generated by ON-OFF state of a switching element in the power-supply unit, thereby produces the driving force.

Each of the first to third cables 21 to 23 is constructed similarly. In other words, each of the first to third cables 21 to 23 comprises a central conductor 201, a coating material 202 covering the central conductor 201, a shield conductor 203 covering the coating material 202, and a sheath 204 as a jacket comprising an insulator covering the shield conductor 203.

The central conductor 201 of the first cable 21, the central conductor 201 of the second cable 22, and the central conductor 201 of the third cable 23 supply the U-phase current, the V-phase current and the W-phase current to the electric motor, respectively. The central conductor 201 is formed by twisting a plurality of strands each of which comprises metal having good electrical conductivity such as copper or aluminum. A terminal 30 is connected to the end of each central conductor 201 of the first to third cables 21 to 23, e.g., by welding.

The connector 3 comprises three terminals 30, a connector housing 40 comprising electrically-conductive metal for housing the ends of the first to third cables 21 to 23 together with the three terminals 30, first to third ferrules 51 to 53 and first and second insulators 41, 42 that are housed in the connector housing 40, a pair of fixing members 61, 62 for fixing the first to third ferrules 51 to 53 to the connector housing 40, and a fastening bolt 31 for fastening the connector 3 to a counterpart connector 7.

The connector housing 40 is formed, e.g., of aluminum die-cast and has a box shape which is opened towards the counterpart connector 7. The first and second insulators 41, 42 are made from resin having electrical insulation, and electrically isolate the terminals 30 from each other and between the terminals 30 and the connector housing 40. The first insulator 41 is placed on a bottom surface 40*a* side of the connector housing 40, and the second insulator 42 is placed on an opening side of the connector housing 40.

The first insulator 41 is fixed to the connector housing 40 by a screw (not shown), and the second insulator 42 is fixed to the first insulator 41 by a screw 43. Also, the second insulator 42 comprises a tabular plate portion 420 fixed to the first insulator 41 and three receiving portions 421 which maintain the terminal 30, respectively. The three receiving portions 421 are stood along the terminal 30 from the plate portion 420 towards an opening side of the connector housing 40.

The three cable insertion holes 401 are formed through the connector housing 40 for introducing the first to third cables 21 to 23, respectively. A sealing ring 43 is placed between an outer peripheral surface of each sheath 204 of the first to third cables 21 to 23 and an inner surface of the cable insertion hole 401, and the sealing ring 43 is prevented from dropping-off by a tail plate 44. Also, an annular sealing member 45 for sealing a gap between a housing 70 of the counterpart connector 7 is placed at a peripheral portion of the opening of the connector housing 40, and this sealing member 45 is prevented from dropping-off by a seal plate 46.

The fastening bolt 31 functions as an axle-shape attaching member for attaching the connector housing 40 to the counterpart connector 7 as an object for attachment, and comprises a hexagonal head 311, a cylindrical trunk 312 and a fastener 313 comprising a male screw as one piece. The head 311 is placed outside the connector housing 40, and the trunk 312 penetrates through the connector housing 40 and the first and second insulators 41, 42.

An annular groove 312*a* is formed at the trunk 312 of the fastening bolt 31 near an end on a head 311 side, and an O-ring 32 is placed in this annular groove 312*a*. The O-ring 32 seals between an outer peripheral surface of the trunk 312 and an inner surface of a bolt insertion hole 402 formed through the connector housing 40. Also, a tip end of the fastener 313 of the fastening bolt 31 is projected from the opening of the connector housing 40.

The first ferrule 51 is provided to correspond to the first cable 21, and the third ferrule 53 is provided to correspond to the third cable 23. The second ferrule 52 is provided to correspond to the second cable 22 and is placed between the first ferrule 51 and the third ferrule 53. The first to third ferrules 51 to 53 are formed to have a tubular shape and comprising electrically conductive metal. For this metal, metals having good electrical conductivity such as aluminum or brass can be preferably used.

The first to third cables 21 to 23 extend in parallel to each other inside the connector housing 40, and the second cable 22 is placed between the first cable 21 and the third cable 23. Also, the first to third cables 21 to 23 vary in length from the cable insertion hole 401 to the terminal 30.

Specifically, a length of the central conductor 201 of the first cable 21 in the connector housing 40 is substantially equal to a length of the central conductor 201 of the third cable 23 in the connector housing 40 and a length of the central conductor 201 of the second cable 22 in the connector housing 40 is shorter than lengths of the first and third cables 21, 23 in the connector housing 40. Here, the "length in the connector housing 40" refers to a length from an outside opening end of the cable insertion hole 401 outside the connector housing 40 to a tip end of the central conductor 201 connected to the terminal 30.

Also, in response to differences in length of the first to third cables 21 to 23, the length in the longitudinal direction (central axis direction) of the second ferrule 52 is shorter than the lengths of the first and third ferrules 51, 53 in the longitudinal direction (central axis direction). Therefore, a space is formed between the terminal 30 connected to the central conductor 201 of the first cable 21 and the terminal 30 connected to the central conductor 201 of the third cable 23, and the fastening bolt 31 is placed in this space. That is, the fastening bolt 31 is placed between the terminal 30 connected to the central conductor 201 of the first cable 21 and the terminal 30 connected to the central conductor 201 of the third cable 23. In other words, the fastening bolt 31 is placed on an extension line of the second cable 22 in the space that is formed by shortening the second cable 22 than the first and third cables 21, 23.

The first to third ferrules 51 to 53 are electrically connected to the shield conductors 203 of the corresponding first to third cables 21 to 23, respectively, and each of which has a tubular shape for introducing the central conductor 201 and the coating material 202. The shield conductor 203 is exposed from the sheath 204 inside each of the first to third ferrules 51 to 53, and this exposed end is turned down outside the sheath 204 and contacts with the inner surface of each of the first to third ferrules 51 to 53. The shield conductor 203 is made of a braid shield in which a plurality of strands are knit to intersect each other to have a mesh shape.

The first to third ferrules 51 to 53 are electrically connected to the connector housing 40 by a pressing force from the pair of fixing members 61, 62. More specifically, a receiving portion 403 is stood on a bottom surface 40*a* of the connector housing 40, and the first to third ferrules 51 to 53 are pressed against this receiving portion 403. Among the pair of fixing members 61, 62, one fixing member 61 presses the first and second ferrules 51, 52 against the receiving portion 403 of the connector housing 40, and the other fixing member 62 presses the second and third ferrules 52, 53 against the receiving portion 403 of the connector housing 40.

A contact surface of the receiving portion 403 with each of the first to third ferrules 51 to 53 is formed into an arc shape along the outer peripheral surface of each of the first to third ferrules 51 to 53. Thereby, the connector housing 40 is in surface contact with each of the first to third ferrules 51 to 53 at the receiving portion 403. Similarly, a contact surface of the one fixing members 61 with each of the first and second ferrules 51 and a contact surface of the other fixing member 62 with each of the second and third ferrules 52, 53 are formed into an arc-shape along the outer peripheral surface of each of the first to third ferrules 51 to 53.

Each of the pair of fixing members 61, 62 is fastened to the connector housing 40 by a screw 47. The screw 47 comprises a male screw and engages threadedly with a threaded hole (not shown) formed at the receiving portion 403. Even though there are manufacturing errors in outer diameter dimensions of the first to third ferrules 51 to 53, the first and second ferrules 51, 52 are pressed against the receiving portion 403 by one fixing members 61 and the second and third ferrules 52, 53 are pressed against the receiving portion 403 by the other fixing member 62, so that a tightening force of the screw 47 tightening the one fixing members 61 acts on the first and second ferrules 51, 52 substantially evenly, and a tightening force of the screw 47 tightening the other fixing member 62 acts on the second and third ferrules 52, 53 substantially evenly.

The counterpart connector 7 comprises a housing 70 comprising electrically conductive metal, a terminal holder 71 comprising electrically insulating resin and being fixed to the housing 70, plural (three in the present application) terminals 72 held by the terminal holder 71, two screws 73 for fixing the terminal holder 71 to the housing 70.

The terminal holder 71 comprises a tabular plate portion 710 fixed to the housing 70 by screws 73, and a plurality of projections 711 that project from the plate portion 710 to surround the terminals 72. The plurality of projections 711 provides a touch protection structure to prevent a finger of the person from contacting the terminals 72 carelessly. Also, a female thread portion 701 with which the fastener 313 of the fastening bolt 31 engages threadedly is formed at the housing 70.

In this embodiment, the terminal 72 of the counterpart connector 7 is a male terminal, and the terminal 30 on the connector 3 side of the wire harness 1 is a female terminal. However, this male-female relation may be reversed. When the connector 3 of the wire harness 1 fits into the counterpart connector 7, the terminal 30 of the connector 3 contacts the terminal 72 of the counterpart connector 7, so that these both terminals 72, 30 are electrically connected to each other. The counterpart connector 7 is fixed to a housing of the above-mentioned electric motor or the power-supply unit. When the fastener 313 of the fastening bolt 31 engages threadedly to the female thread portion 701, the connector housing 40 is fixed to the counterpart connector 7.

In this embodiment, a fitting direction between the connector 3 and the counterpart connector 7 is at right angles to an extension direction of the first to third cables 21 to 23 in the connector housing 40. Thereby, the downsizing of the dimensions in the fitting direction of the connector housing 40 with the counterpart connector 7 is achieved.

Next, with reference to FIGS. 5A, 5B, 6, and 7, a swaging structure of the first and third cables 21, 23 by the first and third ferrules 51, 53 will be described below. It should be noted that the swaging structure of the third cable 23 by the third ferrule 53 is similar to the swaging structure of the first cable 21 by the first ferrule 51 so that the swaging structure by the first ferrule 51 will be described in detail for an example and the redundant explanation about the third ferrule 53 will be omitted.

Figure 5A:
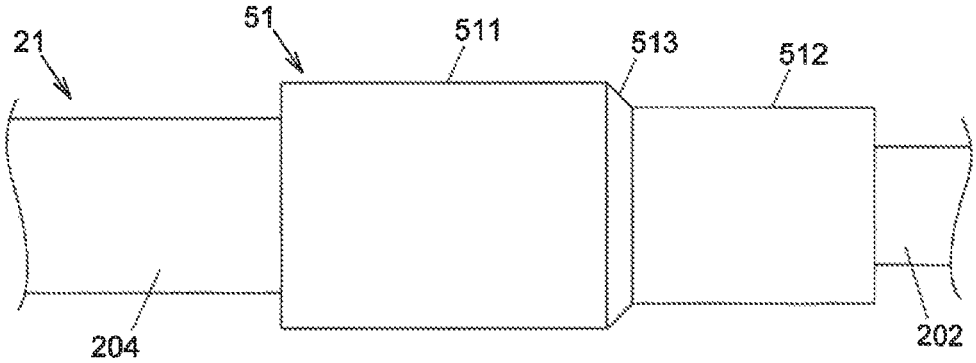
FIG. 5A is a side view showing a first ferrule together with a first cable.
Figure 5B:
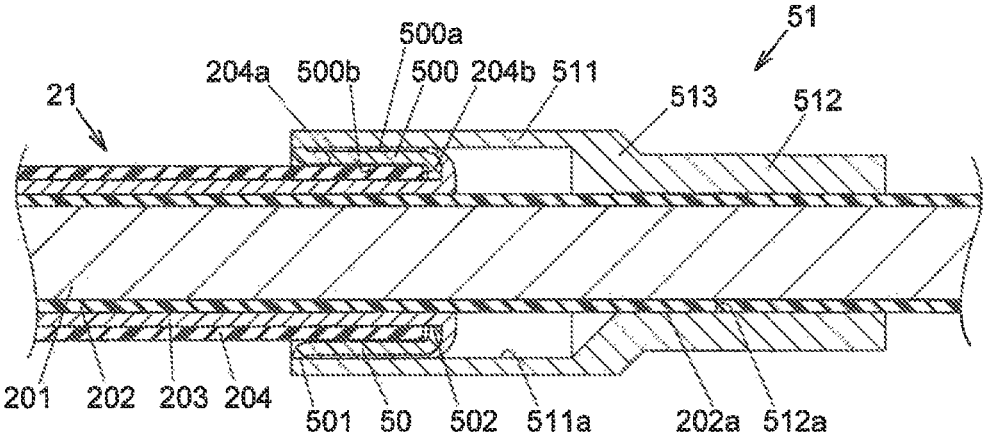
FIG. 5B is a cross sectional view in which the first ferrule and the first cable are cut along a central axis of the first ferrule.
Figure 6:
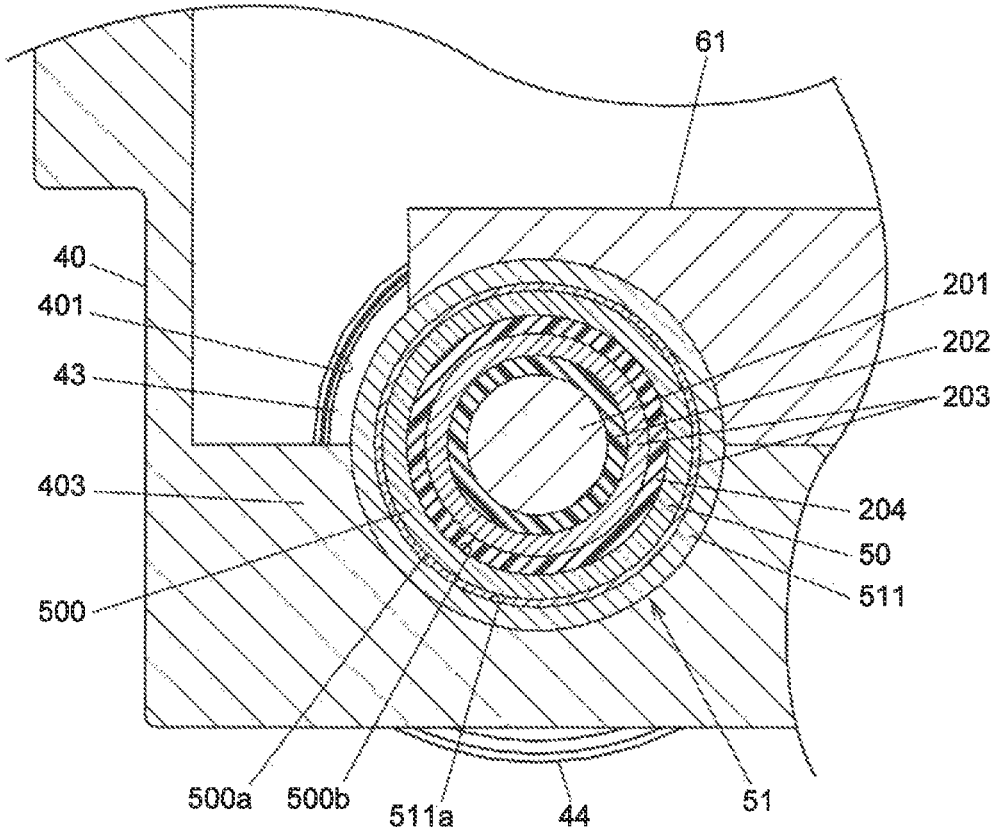
FIG. 6 is a cross sectional view in which the first ferrule and a peripheral portion thereof installed in the connector are cut in a cross section perpendicular to the central axis of the first ferrule.
Figure 7:
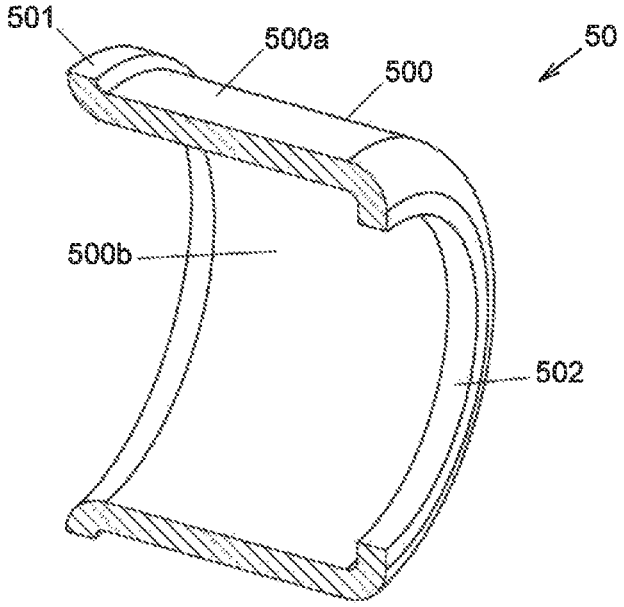
FIG. 7 is a partially broken perspective view showing a part of an inner ring housed in the first ferrule.

FIG. 5A is a side view showing the first ferrule 51 together with the first cable 21. FIG. 5B is a cross sectional view in which the first ferrule 51 and the first cable 21 are cut along a central axis of the first ferrule 51. FIG. 6 is a cross sectional view in which the first ferrule 51 and a peripheral portion thereof installed in the connector 3 are cut in a cross section perpendicular to the central axis of the first ferrule 51. FIG. 7 is a partially broken perspective view showing a part of an inner ring 50 as an inner tubular member housed in the first ferrule 51.

The first ferrule 1S comprises a swaging portion for swaging the shield conductor 203, and a tightening portion for tightening the coating material 202 coating the central conductor 201. In this embodiment, the tightening portion to tighten the coating material 202 is formed by swaging. The swaging portion for swaging the shield conductor 203 is referred to as a first swaging portion 511, and the tightening portion for tightening the coating material 202 is referred to as a second swaging portion 512. Namely, the first ferrule 51 comprises the first swaging portion 511 for swaging the shield conductor 203 and the second swaging portion 512 for tightening the coating material 202.

An intermediate portion 513 having a taper outer peripheral surface is intervening between the first swaging portion 511 and the second swaging portion 512. The second swaging portion 512 is located closer to the terminal 30 than the first swaging portion 511. Namely, the terminal 30 is connected to a tip end of the central conductor 201 which extends from the second swaging portion 512 towards a side opposite to the first swaging portion 511.

Each of the first swaging portion 511 and the second swaging portion 512 has a tubular shape and both have a common central axis. An inner diameter and an outer diameter of the first swaging portion 511 are formed to be smaller than an inner diameter and an outer diameter of the second swaging portion 512.

The inner ring 50 comprising the metal is housed inside the first swaging portion 511. As shown in FIG. 7, the inner ring 50 comprises a tubular pipe portion 500, an annular outer collar portion 501 that projects more outwardly than an outer peripheral surface 500*a* of the pipe portion 500 at one end of the pipe portion 500, and an annular inner collar portion 502 that projects more inwardly than an inner peripheral surface 500*b* of the pipe portion 500 at the other end of the pipe portion 500, as one piece. The inner ring 50 comprises, e.g., metal having good electrical conductivity similarly to the first ferrule 51.

The shield conductor 203 which it is exposed from the sheath 204 and turned down outside the sheath 204 is sandwiched between the inner peripheral surface 511*a* of the first swaging portion 511 in the inner ring 50 and the outer peripheral surface 500*a* of the pipe portion 500 in the first ferrule 51. The outer collar portion 501 of the inner ring 50 abuts with the inner peripheral surface 511*a* of the first swaging portion 511. Also, the inner peripheral surface 500*b* of the pipe portion 500 of the inner ring 50 contacts the outer peripheral surface 204*a* of the sheath 204, and the inner collar portion 502 of the inner ring 50 is facing to an end face 204*b* of the sheath 204.

The inner peripheral surface 512*a* of the second swaging portion 512 of the first ferrule 51 contacts the outer peripheral surface 202*a* of the coating material 202 over an entire periphery of the outer peripheral surface 202*a*. Thereby, vibration in the central conductor 201 and the second swaging portion 512 of the coating material 202 is suppressed.

The first ferrule 51 is formed by reducing the diameter by swaging a tubular metal member having a uniform inner diameter and a uniform outer diameter entirely along a longitudinal direction. In this swaging step, plural (e.g., 6 to 8) swaging claws that are placed radially are pressed against the tubular metal member from the outside of the tubular metal member to reduce the diameter while maintaining the tubular shape. A diameter reduction rate in the second swaging portion 512 by this swaging step (a proportion of a difference of the outer diameter before and after the swaging step with respect to the outer diameter before the swaging step) is greater than a diameter reduction rate in the first swaging portion 511, and the outer diameter of the second swaging portion 512 is smaller than the outer diameter of the first swaging portion 511 because of the difference in the diameter reduction rate.

Similarly to the first ferrule 51, the third ferrule 53 comprises a first swaging portion for swaging the shield conductor 203 of the third cable 23, and a second swaging portion for swaging the coating material 202, and the second swaging portion is located closer to the terminal 30 than the first swaging portion. The first swaging portion of the third ferrule 53 swages the shield conductor 203 of the third cable 23 between the first swaging portion and the inner ring 50 located inside the first swaging portion.

The second ferrule 52 is formed, similarly to the first ferrule 51, by reducing the diameter of the tubular metal member by swaging. Further, in the second ferrule 54, as shown in FIG. 4, an end of the shield conductor 203 of the second cable 22 is turned down outside the sheath 204, and the turned end of the shield conductor 203 is sandwiched between the inner ring 50 and the second ferrule 52. However, the second ferrule 52 does not swage the coating material 202 of the second cable 22. Namely, a second swaging portion for swaging the coating material 202 of the second cable 22 (a portion corresponding to the second swaging portion 512 of the first ferrule 51) is not provided in the second ferrule 52.

In the wire harness 1 as described above, the three terminals 30 of the connector 3 are connected to the three terminals 72 of the counterpart connector 7, respectively, by fitting the connector 3 into the counterpart connector 7, so that the electric current flows through the central conductor 201 of each of the first to third cables 21 to 23 as mentioned above. Also, the fastening bolt 31 penetrating through the connector housing 40 engages threadedly to the female thread portion 701 of the counterpart connector 7, so that the connector housing 40 is fixed securely to the housing 70 of the counterpart connector 7.

Function and Effect of the Embodiment

According to the embodiment, the following function and effect would be provided as follow.

(1) As for the first cable 21, the shield conductor 203 is swaged by the first swaging portion 511 of the first ferrule 51 and the coating material 202 is swaged by the second swaging portion 512, and the second swaging portion 512 is located closer to the terminal 30 than the first swaging portion 511, it is possible to suppress the vibration of the central conductor 201 and the coating material 202 between a part swaged by the first swaging portion 511 of the first ferrule 51 and the terminal 30. Still further, it is possible to suppress the vibration of the terminal 30 due to the vibration propagated to the terminal 30 from the central conductor 201 and the coating material 202. Namely, if the first ferrule 51 does not have the second swaging portion 512, it is possible that the vibration of the central conductor 201 and the coating material 202 closer to the terminal 30 may cause the breakage of a part of strands constituting the central conductor, the detachment of the welded portion between the central conductor 201 and the terminal 30, or the like. This is similar about the third cable 23 swaged by the third ferrule 53. It should be noted that, about the second cable 22, the vibration which may have an influence on the durability hardly occurs because the length of the second cable 22 in the connector housing 40 is shorter than first and third cables 21, 23. The durability of the wire harness 1 is secured by these configurations.

(2) Because the first to third ferrules 51 to 53 are pressed against the receiving part 403 by the fixing members 61, 62, the shield conductors 203 of the first to third cables 21 to 23 are electrically connected to the connector housing 40 via the first to third ferrules 51 to 53. Thereby, it is possible to suppress the leakage of electromagnetic wave irradiated from the central conductor 201 exposed from the shield conductor 403 in the connector housing 40 to the outside of the connector housing 40.

(3) Because the shield conductor 203 is sandwiched between each of the first to third ferrules 51 to 53 and the pipe portion 500 of the inner ring 50, it is possible to suppress the swaging force from being dispersed into the central conductor 201 and the coating material 202, so that it is possible to tighten the shield conductor 203 fairly. Also, because the end of the shield conductor 203 is turned down outside the sheath 204 and the turned end is swaged on the outer periphery side of the inner ring 50, it is possible to swage the shield conductor 203 by the first to third ferrules 51 to 53 more securely.

(4) The second cable 22 has a shorter length than the first and third cables 21, 23 in the connector housing 40, and the fastening bolt 31 is placed between the terminal 30 connected to the central conductor 201 of the first cable 21 and the terminal 30 connected to the central conductor 201 of the second cable 22. Therefore, in comparison with the case where the length of the second cable 22 is substantially equal to the lengths of the first and third cables 21, 23 in the connector housing 40, it is possible to downsize the connector 3. Also, the length of the second cable 22 is longer than the first and third cable 21, 23 in the connector housing 40, so that a distance between the terminals 30 is increased, thereby enhancing insulating properties by the increase in the creepage distance.

Summary of the Embodiment

Next, the technical concept that is ascertained from the embodiments described above will be described with the aid of the reference characters and the like in the embodiment. It should be noted, however, that each of the reference characters in the following description should not be construed as limiting the constituent elements in the claims to the members and the like specifically shown in the embodiments.

[1] A wire harness (1) comprises a cable (21) comprising a central conductor (201), a coating material (202) that coats the central conductor (201), and a shield conductor (203) that covers the coating material (202); a terminal (30) that is connected to the central conductor (201) of the cable (21); a connector housing (40) that houses an end of the cable (21) together with the terminal (30); a ferrule (51), that is electrically connected to the shield conductor (203) and comprises a tubular metal, into which the central conductor (201) and the coating material (202) inserted; and a fixing member (61) that fixes the ferrule (51) to the connector housing (40), in which the ferrule (51) comprises a swaging portion (a first swaging portion 511) for swaging the shield conductor (203) and a tightening portion (a second swaging portion 512) for tightening the coating material (202), wherein the tightening portion (512) is located closer to the terminal (30) than the swaging portion (511).

[2] In the wire harness (1) as described in the above [1], the connector housing (40) comprises an electrically conductive metal, and the ferrule (51) is electrically connected to the connector housing (40) by receiving a pressing force from the fixing member (61).

[3] The wire harness (1) as described in the above [1] or [2], further comprises an inner tubular member (50) housed in the ferrule (51), the shield conductor (203) being sandwiched between the inner tubular member (50) and an inner peripheral surface (511*a*) of the ferrule (51).

[4] The wire harness (1) as described in the above [3], further comprises a jacket (204) comprising an insulator and covering the shield conductor (203), an end of the shield conductor (203) being turned down outside the jacket (204) in the ferrule (51), the turned end of the shield conductor (203) being sandwiched between the inner tubular member (50) and the ferrule (51).

[5] In the wire harness (1) as described in the above [1], the cable comprises three cables (21 to 23), in which the central conductor (201) of one cable (22) of the three cables (21 to 23) has a shorter length than the central conductors (201) of the other cables (21, 23) in the connector housing (40), and the ferrule (52) connected to the shield conductor (203) of the one cable (22) is not provided with the tightening portion (512) and the one cable (22) is placed between the other cables (21, 23), and an attaching member (31) for attaching the connector housing (40) to an object for attachment (7) is placed between the terminals (30) connected to the central conductors (201) of the other cables (21, 23).

Although the embodiment of the present invention has been described above, the embodiment described above should not be construed as limiting the invention in the appended claims. It should also be noted that not all the combinations of the features described in the above embodiment are essential to the means for solving the problems of the invention.

The present invention may be enforced with appropriate modification without going beyond the gist of the invention. For example, in the embodiment, the case where the wire harness 1 is used for supplying the driving current to the electric motor which produces the driving force for running in the vehicle is described, but the application of the wire harness 1 is not limited thereto and can be applied to various applications.

Also, in the above embodiment, the case where the wire harness 1 comprises three cables is described, but the number of the cables is not limited thereto and may be one or two, or four or more.

Further, in the above embodiment, the case where the tightening portion to tighten the coating material 202 is formed by swaging is described, but the present invention is not limited thereto. The tightening portion may be tightened by, e.g., press-fitting of the coating material 202 into the first and third ferrules 51, 53. Namely, it is enough if the first and third ferrules 51, 53 tighten the coating material 202 at an end on the terminal 30 side in the longitudinal direction and the inner peripheral surface adheres with the outer peripheral surface of the coating material 202. Even, in this case, it is possible to provide the effect similar to the case where the coating material 202 is tightened by swaging.

Still further, in the embodiment, the case where the shield conductor 203 is swaged between the first swaging portion 511 of the first ferrule 51 and the inner ring 50 is described. However, if it is possible to contact the first ferrule 51 to the shield conductor 203 while maintaining sufficient strength and contact resistance, the inner ring 50 does not need to be used. It is similar about the second and third ferrules 52, 53.

EXPLANATION OF REFERENCE NUMERALS

1 . . . Wire harness
201 . . . Central conductors
202 . . . Coating material
203 . . . Shield conductors
204 . . . Sheath (Jacket)
21 to 23 . . . First to third cables
30 . . . Terminal
31 . . . Fastening bolt (Attaching member)
40 . . . Connector housing
50 . . . Inner ring (Inner tubular member)
500 . . . Pipe portion
501 . . . Outer collar portion
502 . . . Inner collar portion
51 to 53 . . . First to third ferrules
511 . . . First swaging portion
512 . . . Second swaging portion
61, 62 . . . Fixing members
7 . . . Counterpart connector (Object for attachment)

What is claimed is:

1. A wire harness, comprising:

a cable comprising a central conductor, a coating material that coats the central conductor, and a shield conductor that covers the coating material;

a terminal that is connected to the central conductor of the cable;

a connector housing that houses an end of the cable together with the terminal;

a ferrule, that is electrically connected to the shield conductor and comprises a tubular metal, into which the central conductor and the coating material are inserted; and a fixing member that fixes the ferrule to the connector housing, wherein the ferrule comprises a swaging portion for swaging the shield conductor and a tightening portion for tightening the coating material, wherein the tightening portion is located closer to the terminal than the swaging portion, and wherein the fixing member presses the ferrule against the connector housing.

2. The wire harness, according to claim 1, wherein the connector housing comprises an electrically conductive metal, and the ferrule is electrically connected to the connector housing by receiving a pressing force in a direction intersecting with a longitudinal direction of the cable from the fixing member.

3. The wire harness, according to claim 1, further comprising:

an inner tubular member housed in the ferrule, the shield conductor being sandwiched between the inner tubular member and an inner peripheral surface of the ferrule.

4. The wire harness, according to claim 3, further comprising:

a jacket covering the shield conductor, an end of the shield conductor being turned down outside the jacket in the ferrule, the end of the shield conductor being sandwiched between the inner tubular member and the ferrule.

5. The wire harness, according to claim 1, wherein the ferrule is electrically connected to the connector housing by receiving a pressing force in a direction intersecting with a longitudinal direction of an extension of the cable from the fixing member.

6. The wire harness, according to claim 1, wherein the fixing member presses the ferrule against the connector housing in a direction intersecting with a longitudinal direction of an extension of the cable from the fixing member.

7. The wire harness, according to claim 1, further comprising:

an inner tubular member housed in the ferrule; and a jacket covering the shield conductor, an end of the shield conductor being turned down outside the jacket in the ferrule.

8. The wire harness, according to claim 7, wherein the end of the shield conductor is sandwiched between the inner tubular member and the ferrule.

9. The wire harness, according to claim 1, wherein the cable comprises a plurality of cables, and wherein the central conductor of one cable of the cables has a shorter length than the central conductors of other cables in the connector housing.

10. The wire harness, according to claim 9, wherein the ferrule connected to the shield conductor of the one cable is not provided with the tightening portion and the one cable is placed between the other cables.

11. The wire harness, according to claim 10, wherein an attaching member for attaching the connector housing to an object is placed between the terminals connected to the central conductors of the other cables.

12. The wire harness, according to claim 9, wherein an attaching member for attaching the connector housing to an object is placed between the terminals connected to the central conductors of the other cables.

13. The wire harness, according to claim 1, wherein the fixing member is fastened to the connector housing by a screw.

14. The wire harness, according to claim 1, wherein an inner peripheral surface of the tightening portion of the ferrule contacts an outer peripheral surface of the coating material over an entire periphery of the outer peripheral surface of the coating material.

15. The wire harness, according to claim 1, wherein a length of the central conductor is a length from an outside opening end of a cable insertion hole outside the connector housing to a tip end of a central conductor connected to the terminal.

16. A wire harness, comprising:

a plurality of cables, each cable comprising a central conductor, a coating, material that coats the central conductor, and a shield conductor that covers the coating material;

a plurality of terminals, each of which is connected to the central conductor of each cable;

a connector housing that houses an end of the plurality of cables together with the plurality of terminals;

a ferrule, that is electrically connected to the shield conductor and comprises a tubular metal, into which the central conductor and the coating material are inserted; and a fixing member that fixes the ferrule to the connector housing, wherein the ferrule comprises a swaging portion for swaging the shield conductor and a tightening portion for tightening the coating material, wherein the tightening portion is located closer to the terminal than the swaging portion, and wherein the fixing member presses the ferrule against the connector housing.

17. The wire harness, according to claim 16, further comprising:

an inner tubular member housed in the ferrule, the shield conductor being sandwiched between the inner tubular member and an inner peripheral surface of the ferrule; and a jacket comprising an insulator and covering the shield conductor, an end of the shield conductor being turned down outside the jacket in the ferrule, the end of the shield conductor being sandwiched between the inner tubular member and the ferrule.

18. The wire harness, according to claim 16, wherein the central conductor of one cable of the cables has a shorter length than the central conductors of other cables in the connector housing, and the ferrule connected to the shield conductor of the one cable is not provided with the tightening portion and the one cable is placed between the other cables, and an attaching member for attaching the connector housing to an object is placed between the terminals connected to the central conductors of the other cables.

19. A wire harness, comprising:

a cable comprising a central conductor, a coating material that coats the central conductor, and a shield conductor that covers the coating material;

a terminal that is connected to the central conductor of the cable;

a connector, housing that houses an end of the cable together with the terminal;

a ferrule, that is electrically connected to the shield conductor and comprises a tubular metal, into which the central conductor and the coating material are inserted;

a fixing member that fixes the ferrule to the connector housing, wherein the ferrule comprises a swaging portion for swaging the shield conductor and a tightening portion for tightening the coating material, and wherein the tightening portion is located closer to the terminal than the swaging portion;

an inner tubular member housed in the ferrule, the shield conductor being sandwiched between the inner tubular member and an inner peripheral surface of the ferrule; and a jacket comprising an insulator and covering the shield conductor, an end of the shield conductor being turned down outside the jacket in the ferrule, the turned end of the shield conductor being sandwiched between the inner tubular member and the ferrule.

20. A wire harness, comprising:

a cable comprising a central conductor a coating material that coats the central conductor, and a shield conductor that covers the coating material;

a terminal that is connected to the central conductor of the cable;

a connector housing that houses an end, of the cable together with the terminal; and a ferrule, that is electrically connected to the shield conductor and comprises a tubular metal, into which the central conductor and the coating material are inserted, a fixing member that fixes the ferrule to the connector housing, wherein the ferrule cone a swaging portion for swaging the shield conductor and a tightening portion for tightening the coating material, wherein the tightening portion is located closer to the terminal than the swaging portion, wherein the cable comprises three cables, and wherein the central conductor of one cable of the three cables has a shorter length than the central conductors of other cables in the connector housing, and the ferrule connected to the shield conductor of the one cable is not provided with the tightening portion and the one cable is placed between the other cables, and an attaching member for attaching the connector housing to an object for attachment is placed between the terminals connected to the central conductors of the other cables.

* * * * *